United States Patent [19]

Wu

[11] 4,386,772

[45] Jun. 7, 1983

[54] TRAMPOLINE WITH HORIZONTAL AND VERTICAL ELASTIC FORCE

[75] Inventor: Hann C. Wu, Tainan, Taiwan

[73] Assignee: Horng Meei Spring Enterprise Co., Ltd., Tainan, Taiwan

[21] Appl. No.: 256,715

[22] Filed: Apr. 23, 1981

[51] Int. Cl.[3] ..... A63B 5/18

[52] U.S. Cl. ..... 272/65

[58] Field of Search ..... 272/65, 70, 144; 5/110, 5/111, 114; 182/138, 139, 140

[56] References Cited

U.S. PATENT DOCUMENTS

| | | | |
|---|---|---|---|
| 952,871 | 3/1910 | Browder | 182/139 |
| 2,066,182 | 12/1936 | Lenz | 272/65 UX |
| 2,430,714 | 11/1947 | Geer | 182/139 |
| 2,799,867 | 7/1957 | Fenner et al. | 272/65 |
| 2,969,124 | 1/1961 | Nissen | 272/65 |
| 3,004,623 | 10/1961 | Nissen | 182/139 X |
| 3,677,368 | 7/1972 | Green | 272/65 |
| 4,284,271 | 8/1981 | Pettit et al. | 182/139 X |

OTHER PUBLICATIONS

Scientific American, Apr. 1961, DuPont MYLAR® Polyester Film.

*Primary Examiner*—Richard C. Pinkham
*Assistant Examiner*—Arnold W. Kramer
*Attorney, Agent, or Firm*—Armstrong, Nikaido, Marmelstein & Kubovcik

[57] ABSTRACT

This invention relates to a trampoline with horizontal tension springs and vertical compression springs, characterized in that each leg has a compression spring installed in it so as to get an excellent jumping ability.

Further, the trampoline legs of this invention are detachable and its frames are foldable, as a result, its dimension after packing is reduced.

4 Claims, 6 Drawing Figures

TRAMPOLINE WITH HORIZONTAL AND VERTICAL ELASTIC FORCE

BACKGROUND OF THE INVENTION

The conventional trampoline only has the horizontal tension springs, so its jumping ability is not good; further, its integral structure is not detachable and foldable, as a result, its dimension after packing is quite large so as to increase the transportation inconvenience and the freight. In order to overcome the said defects, we therefore offer this invention as a solution.

SUMMARY OF THE INVENTION

Besides the horizontal springs, the trampoline has a compression spring installed in each leg, so its jumping ability is excellent. Further, the trampoline legs of this invention are detachable and its frames are foldable, as a result, its dimension after packing is reduced so that the related freight can be saved almost up to 50 percent when comparing with the conventional structure one, and the transportation becomes easier accordingly.

DETAILED DESCRIPTION OF PREFERRED EMBODIMENT

Figure 5:
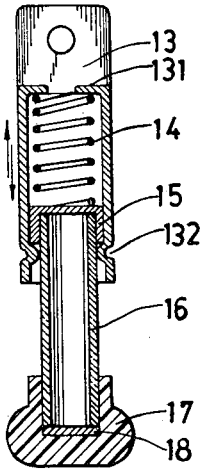
FIG. 5 is a sectional view, referring to the trampoline leg as shown in FIG. 4, A—A.
Figure 6:
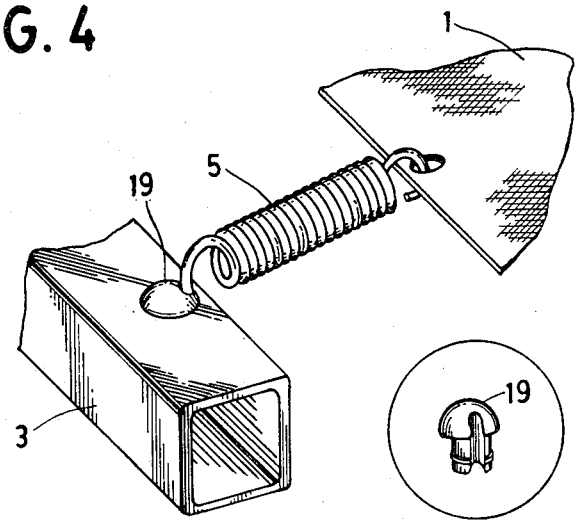
FIG. 6 is an indicative view referring to the shackling method between the horizontal spring and the trampoline frame and also is an outline of the notched plug.

This invention is composed of foldable left and right trampoline frames (3), (4), many horizontal tension springs (5), the strong cloth (1), many detachable trampoline legs and protectors (2), in which the left half frame (3) and the right half frame (4) are connected by two U-shaped irons (6) and two flat irons (7) in opposite positions. The strong PV cloth (1) is tightly stretched open by 24 pieces of horizontal tension springs (5) and shackled to the left and right frames (3) and (4), further, the notched plugs (19) are inserted into the shackling holes to prevent the releasing of the horizontal springs in the case of folding the frames. The elements (10) as shown in the Figure represent the flexible stay bolts and the elements (9) the nuts. The trampoline leg with vertical springs (14) is composed of the upper square tube (13), the lower round tube (16) and the plastic stand (17), all of which are assembled to form an integral assembly. The metal piece (18), as shown in FIG. 5, represents the shape of the iron in cross-section.

The trampoline legs comprise 8 pieces per set and require bolts (11) and nuts (12) and nuts 12 to connect them with the left and right frames (3) and (4). Then they are covered by the protectors (2) in which the springs are attached, thus completing the assembly.

Figure 1:
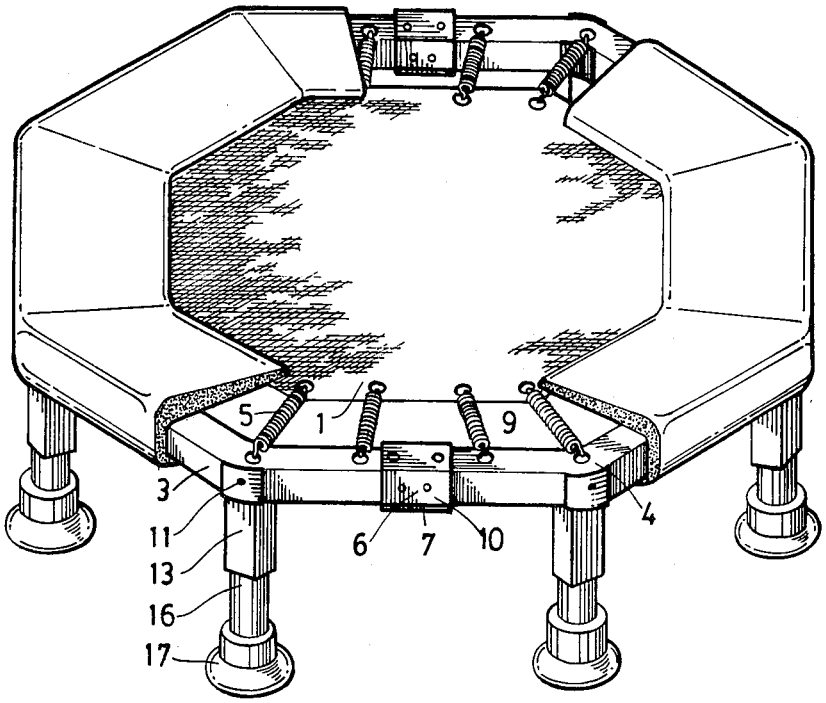
FIG. 1 is an outline, referring to "The trampoline with horizontal and vertical elastic force" of this invention. (a part of horizontal spring protector is sectioned).
Figure 3:
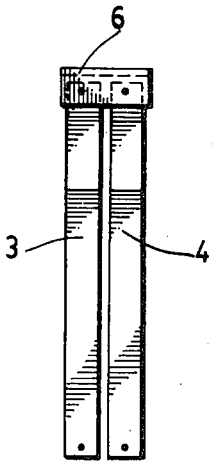
FIG. 3 is an indicative view, referring to the folding direction of the trampoline frame after the trampoline legs of this invention are detached.
Figure 2:
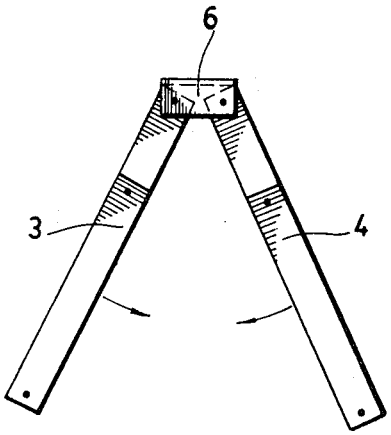
FIG. 2 is an indicative view, referring to the completion of folding the trampoline frame of this invention.
Figure 4:
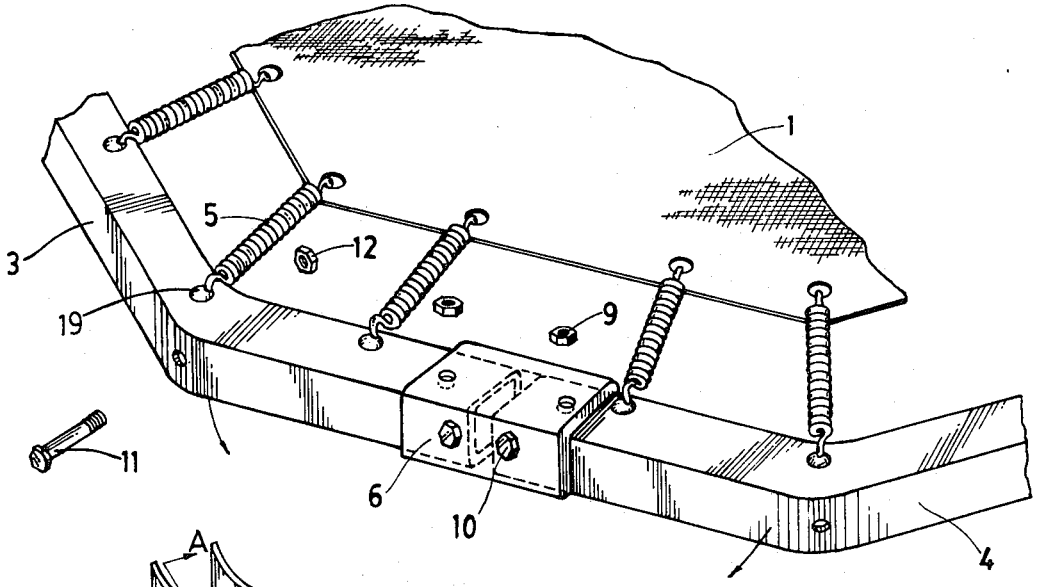
FIG. 4 is a partly disassembling view, referring to the trampoline of this invention.
Figure 4:
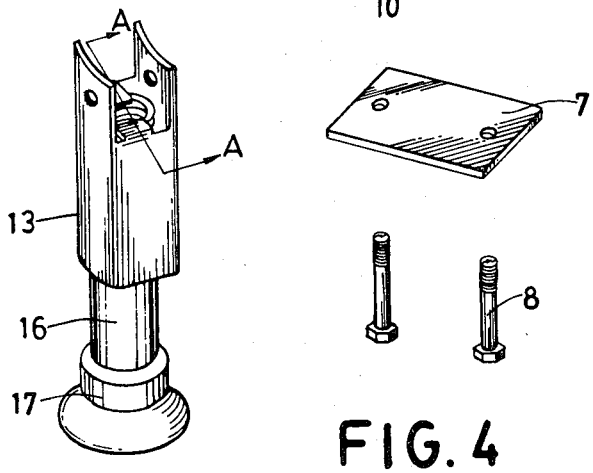

In order not to scatter the internal parts when they are detached from the trampoline leg, the iron plate of the trampoline leg's upper portion (13) is bent inward at the (131) position to prevent the upward releasing of the spring (14), further, at position (132), the iron plate is made indented inward to prevent the downward releasing of the springs and the round tube legs (16). As the round tube lid (15) and the round tube leg (16) are united to each other, they are not detachable when the 8 pieces of legs are detached. The folding of the trampoline frame is made as follows: After the 8 pieces of trampoline legs are detached, the coupling bolts (8) and nuts 9 on the flat irons (7) which are used to connect the left and right frames (3) and (4) are subsequently detached, then, the trampoline frames can be folded in the direction as shown in FIG. 2 to become the shape as shown in FIG. 3.

As the above mentioned trampoline has the horizontal and vertical elastic force which can increase the jumping ability, it is very practical. Further, as it is suitable for folding and detaching, it is convenient for packing and transportation which will improve the management effect.

I claim:

1. A trampoline with horizontal tension springs and vertical compression springs, said trampoline comprising at least two trampoline frame means; a plurality of horizontal tension springs connected to said frame means; a strong cloth connected to said tension springs; a plurality of detachable trampoline legs coupled to said frame means; and at least one protector for covering said frame means, said horizontal tension springs and the outer edge of said cloth characterized in that each of the detachable trampoline legs comprise an upper tube, having four sides with two of the opposite sides extending upwardly to straddle the frame means and be releasably attached thereto, a lower round tube telescoped in said upper tube and a plastic stand on the lower end of said round tube, wherein the upper tube and the lower round tube has a compression spring therein to increase the jumping ability of the trampoline, said upper tube being formed from an iron plate having an inwardly bent portion at the top of at least one side to prevent the upward releasing of the spring therein; and means having a respective inverted U-shaped metal means for pivotally connecting the two trampoline frame means together at their respective ends for using said trampoline when the inverted U-shaped metal means holds said frame means in the same plane, and for allowing folding said two trampoline frame means while said U-shaped metal means is still connected thereto.

2. The trampoline as defined in claim 1, characterized in that notched plugs are inserted into holes in the frame means in which the tension springs are shackled to the left and right frames, to prevent the releasing of the horizontal tension springs in the case of folding the trampoline frame.

3. The trampoline of claim 1 in which the two trampoline frame means are left and right frames and the inverted U-shaped metal means are in the form of inverted U-shaped plates, including two removable bolts and nuts on each of which a respective frame means pivots, for connecting the left and right frames so that the trampoline is suitable for convenient folding, packing and transporting.

4. The trampoline of claim 1 in which the upper tube includes a lid fixed over the top of the round leg and on which the compression spring sits, said upper tube being indented at the bottom below the lid to prevent the downward releasing of the compression spring and the round tube leg respectively.

* * * * *